US007048072B2

(12) United States Patent
Okunishi et al.

(10) Patent No.: US 7,048,072 B2
(45) Date of Patent: May 23, 2006

(54) EXCAVATOR

(75) Inventors: Takayuki Okunishi, Hiroshima (JP); Shintaro Sakitani, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 38 days.

(21) Appl. No.: 11/103,548

(22) Filed: Apr. 12, 2005

(65) Prior Publication Data

US 2005/0230129 A1 Oct. 20, 2005

(30) Foreign Application Priority Data

Apr. 15, 2004 (JP) ..... 2004-120588

(51) Int. Cl.

| | |
|---|---|
| ***E02F 3/76*** | (2006.01) |
| ***E02F 3/80*** | (2006.01) |
| ***E01H 5/06*** | (2006.01) |

(52) U.S. Cl. ..... 172/811; 172/701.1; 37/266

(58) Field of Classification Search ..... 37/206, 37/214, 233, 253, 266–268, 279–285, 341, 37/379, 381, 398, 407–411, 443–445, 461, 37/184–188; 172/777–799.5, 810–827, 684.5, 172/701.1–701.3

See application file for complete search history.

(56) References Cited

U.S. PATENT DOCUMENTS

2004/0237353 A1 12/2004 Takayuki et al. ..... 37/403

FOREIGN PATENT DOCUMENTS

| | | | |
|---|---|---|---|
| DE | 3039364 A1 | * | 5/1982 |
| EP | 0273400 | * | 12/1987 |
| EP | 11093209 | * | 4/1999 |
| FR | 2450913 | * | 10/1980 |
| JP | 2002-322668 | * | 11/2002 |

* cited by examiner

*Primary Examiner*—Christopher J. Novosad
(74) *Attorney, Agent, or Firm*—Oblon, Spivak, McClelland, Maier & Neustadt, P.C.

(57) ABSTRACT

In an excavator, a blade surface for performing an earth removal operation while a blade is set in contact with the ground satisfies the following conditions: A) upward pushing force components Fu that push dirt upward along the blade surface are generated; B) an upper part of the blade surface has a release surface portion in which a forward-upward release force that rolls the dirt pushed upward by Fu forward is generated; C) when downward pressing force components Fd are generated in response to the generated release force, a total downward pressing force ΣFd> a total upward pushing force ΣFu; and D) if each Fu is given a positive value and if each Fd and a reduced amount of each Fu caused when the dirt hits the release surface portion are given negative values, a value of force at an endmost section of the release surface portion is positive.

6 Claims, 7 Drawing Sheets

EXCAVATOR

BACKGROUND OF THE INVENTION

1. Field of the Invention

The present invention relates to an excavator equipped with a dozer unit for performing an earth removal operation.

2. Description of the Related Art

Referring to FIG. 7, when performing an earth removal operation using a typical excavator equipped with a dozer unit 10 of related art, a blade 12 is projected in a direction indicated by an arrow a in FIG. 7. In this case, however, the dirt accumulated above the blade 12 falls backward over the top surface of the blade 12 in a direction indicated by an arrow b, and thus roughens the finished surface. To prevent this, an additional process is required, such as temporarily raising the blade 12 upward so as to sweep the upper portion of the pile of dirt in the forward direction, or backing up the excavator in order to level the ground over again. As a result, this significantly lowers the efficiency of the earth removal operation.

In order to reduce the amount of dirt falling behind the blade 12 to the greatest possible extent, the height of the blade 12 may be made sufficiently larger with respect to the width of the blade 12.

In such a structure, however, since the dozer unit 10 is disposed below an excavating attachment unit (not shown), and the excavating attachment unit may be lowered by a large degree during an excavation process, the dozer unit 10 and the excavating attachment unit could possibly interfere with each other. For this reason, the height of the blade 12 could not be made sufficiently large, thus creating a condition where the dirt can easily fall backward.

Referring to FIGS. 7 and 8, the upper part of the blade surface 15 is curved forward by a great degree in an overhanging manner. Such a shape of the blade surface 15 is an attempt to prevent the dirt from falling backward by allowing downward pressing force components Fd to be generated.

FIG. 8 illustrates the blade surface 15, which is divided into a plurality of sections NO1 to NO10 in the height direction. Each section is given an approximate line that indicates the generation status of a force component. In FIG. 8, each reference character Fu indicates an upward pushing force component that pushes dirt upward along the blade surface 15, and each reference character Fd indicates a downward pressing force component that presses the dirt downward.

The shape of the blade surface 15 is determined based on the following conditions. Specifically, in a lower surface portion 15*a*, which extends from the lower end to an intermediate point of the blade surface 15 and is defined by the sections NO1 to NO4, the upward pushing force components Fu are generated. On the other hand, in an upper surface portion 15*b*, which extends from the intermediate point to the upper end of the blade surface 15 and is defined by the sections NO5 to NO10, the downward pressing force components Fd are generated. Furthermore, a total downward pressing force ΣFd is substantially equal to a total upward pushing force ΣFu. Although the actual relationship is ΣFu>ΣFd, the ratio between the two is close to 50:50.

However, since most of the upward pushing force components Fu are countered by the downward pressing force components Fd, the actual upward pushing force remaining at the upper part of the blade surface 15 is small. This results in a state where the dirt accumulates without rolling forward and thus forms a pile of dirt having a long bottom portion L, as shown in FIG. 7. For this reason, in response to an advancing force of the blade 12, the pile of dirt may easily collapse in the backward direction.

Furthermore, according to an experiment performed by the inventors of the present invention, it has been discovered that an energy loss is actually caused when the dirt hits the blade surface 15 and that such an energy loss is one of the factors that reduces the magnitude of each upward pushing force component Fu. Consequently, according to the dozer unit 10 in which the remaining values of the upward pushing force components Fu at the upper part of the blade surface 15 are small, the dirt can easily fall backward over the blade 12, thus lowering the efficiency of the earth removal operation.

SUMMARY OF THE INVENTION

Accordingly, it is an object of the present invention to provide an excavator that is capable of efficiently rolling dirt pushed upward by a dozer unit in the forward direction to inhibit the dirt from falling backward of the dozer unit so as to improve the efficiency of the dozer operation.

An excavator according to the present invention has the following basic characteristics.

Specifically, the excavator includes a lower traveling body; and a dozer unit attached to the lower traveling body, the dozer unit including a dozer arm and a blade attached to a front end of the dozer arm in a manner such that the blade is disposed at a predetermined rake angle with respect to the ground. The blade has a blade surface used for performing an earth removal operation by moving the lower traveling body while the blade is set in contact with the ground. The blade surface satisfies the following conditions:

A) upward pushing force components Fu that push dirt upward along the blade surface are generated;

B) an upper part of the blade surface is provided with a release surface portion in which a forward-upward release force that rolls the dirt pushed upward by the upward pushing force components Fu towards the front of the blade is generated;

C) when downward pressing force components Fd are generated in response to the generation of the release force a total downward pressing force ΣFd and a total upward pushing force ΣFu form the relationship ΣFu>ΣFd; and D) if each upward pushing force component Fu is indicated by a positive value and if each downward pressing force component Fd and a reduced amount of each upward pushing force component Fu caused when the dirt hits the release surface portion are indicated by negative values, a value of force applied to the dirt at an endmost section of the release surface portion is positive.

The behavior of dirt during a dozer operation depends on the direction from which the dirt receives force from the blade surface and on the magnitude of the force. In other words, scraped dirt is transferred upward along the blade surface due to the upward pushing force components, but tries to fall downward due to the downward pressing force components. By changing the direction of the upward pushing force components to the forward direction, a release force that tries to roll the dirt forward is generated. When such a release force is sufficiently large, the dirt can be rolled efficiently in the forward direction.

According to the present invention, a sufficiently large release force can be generated due to the fact that the blade surface is given a shape the allows the direction of the upward pushing force components Fu to be changed to the forward direction at the release surface portion provided in the upper part of the blade surface, and moreover, that satisfies the following conditions:

(i) the total upward pushing force ΣFu, which is a source of the release force, is greater than the total downward pressing force ΣFd; and (ii) if each upward pushing force component Fu is indicated by a positive value and if each downward pressing force component Fd and a reduced amount of each upward pushing force component Fu caused when the dirt hits the release surface portion are indicated by negative values, the value of force applied to the dirt at an endmost section of the release surface portion is positive.

Accordingly, the dirt at the upper part of the blade surface can be rolled efficiently in the forward direction like a tidal wave so that a pile of dirt that collapses easily in the forward direction and that has a short bottom portion can be formed. Moreover, the dirt can also be pushed quickly and smoothly away towards the opposite lateral sides of the blade. As a result, this achieves a higher efficiency for performing the earth removal operation.

DESCRIPTION OF THE PREFERRED EMBODIMENT

An embodiment of an excavator according to the present invention will now be described with reference to FIGS. 1 to 6.

Figure 6:
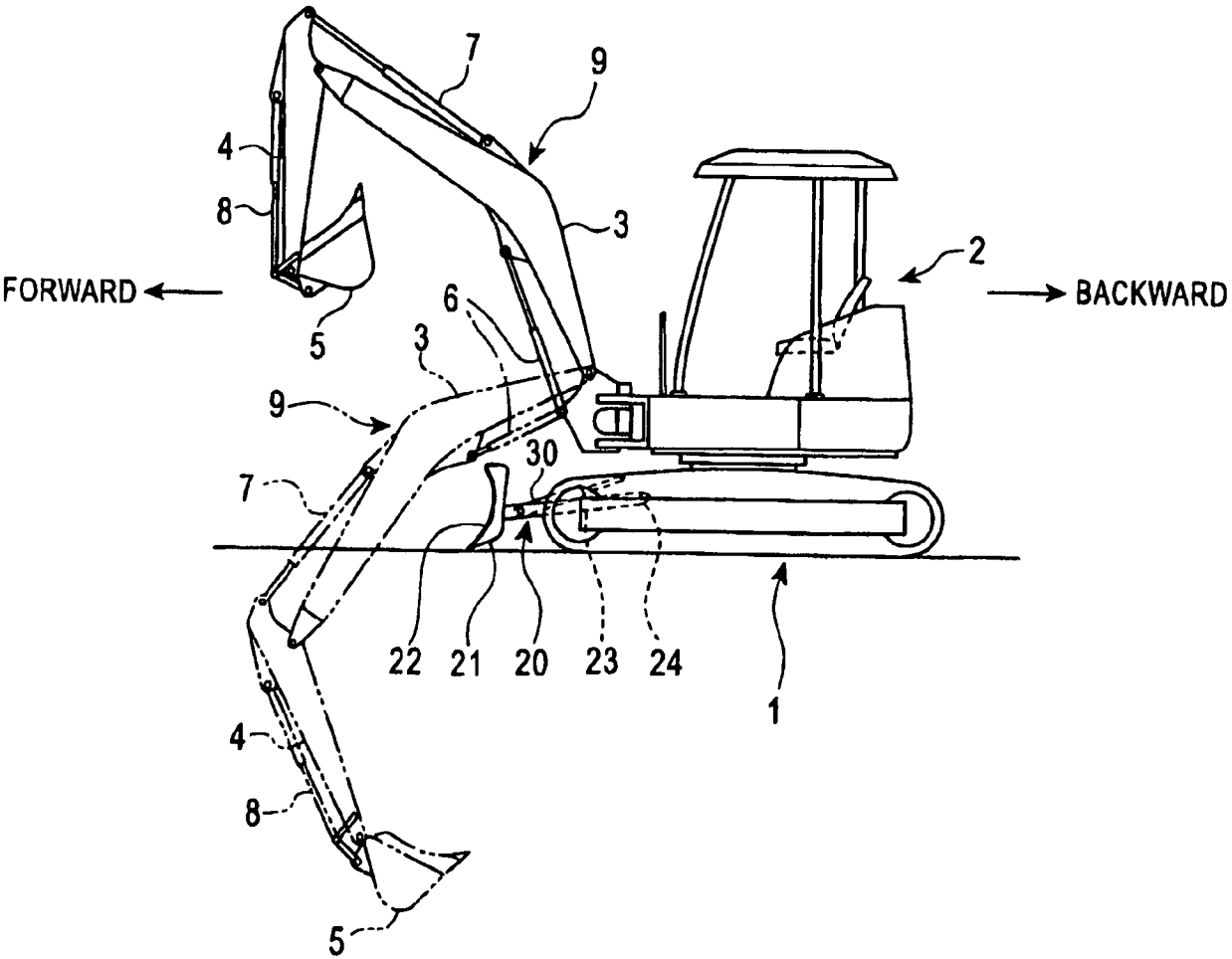
FIG. 6 is a schematic side view of an excavator.

FIG. 6 illustrates an excavator according to an embodiment of the present invention. Such an excavator is known as a mini-excavator that is equipped with a dozer unit. The excavator includes a crawler-type lower traveling body 1 on which an upper rotatable body 2 is disposed in a rotatable manner about a vertical axis. The upper rotatable body 2 is provided with an excavating attachment unit 9 which includes a boom 3, an arm 4, a bucket 5, and hydraulic cylinders 6, 7, and 8 for respectively driving the boom 3, the arm 4, and the bucket 5.

The excavator further includes a dozer unit 20 provided with a dozer arm 23 and a blade 21. The blade 21 is attached to the front end of the dozer arm 23 in a manner such that the blade 21 is disposed at a predetermined rake angle θ with respect to the ground. On the other hand, the base end of the dozer arm 23 is attached to the lower traveling body 1 via a horizontal arm shaft 24.

The dozer arm 23 and the lower traveling body 1 have a dozer cylinder 30 disposed therebetween. The expanding and contracting motions of the dozer cylinder 30 allow the dozer arm 23 to tilt about the arm shaft 24 functioning as a fulcrum, whereby the blade 21 can be moved in the vertical direction.

In order to perform an earth removal operation using the dozer unit 20, the lower traveling body 1 is moved forward while the lower end of the blade 21 is in contact with the ground. Consequently, due a pressing force applied in the forward direction in FIG. 6, the front surface, i.e. a blade surface 22, of the blade 21 scrapes the ground, whereby the earth removal operation can be performed.

The earth removal operation is performed in the following manner:

1. Scraped dirt begins to accumulate in front of the blade surface 22.
2. The accumulated dirt is pushed upward along the blade surface 22.
3. The dirt pushed upward rolls forward and then collapses due to upward pushing force components and its own weight.
4. The collapsed dirt is pushed away towards the opposite lateral sides of the blade 21 from the center of the blade 21.

Figure 1:
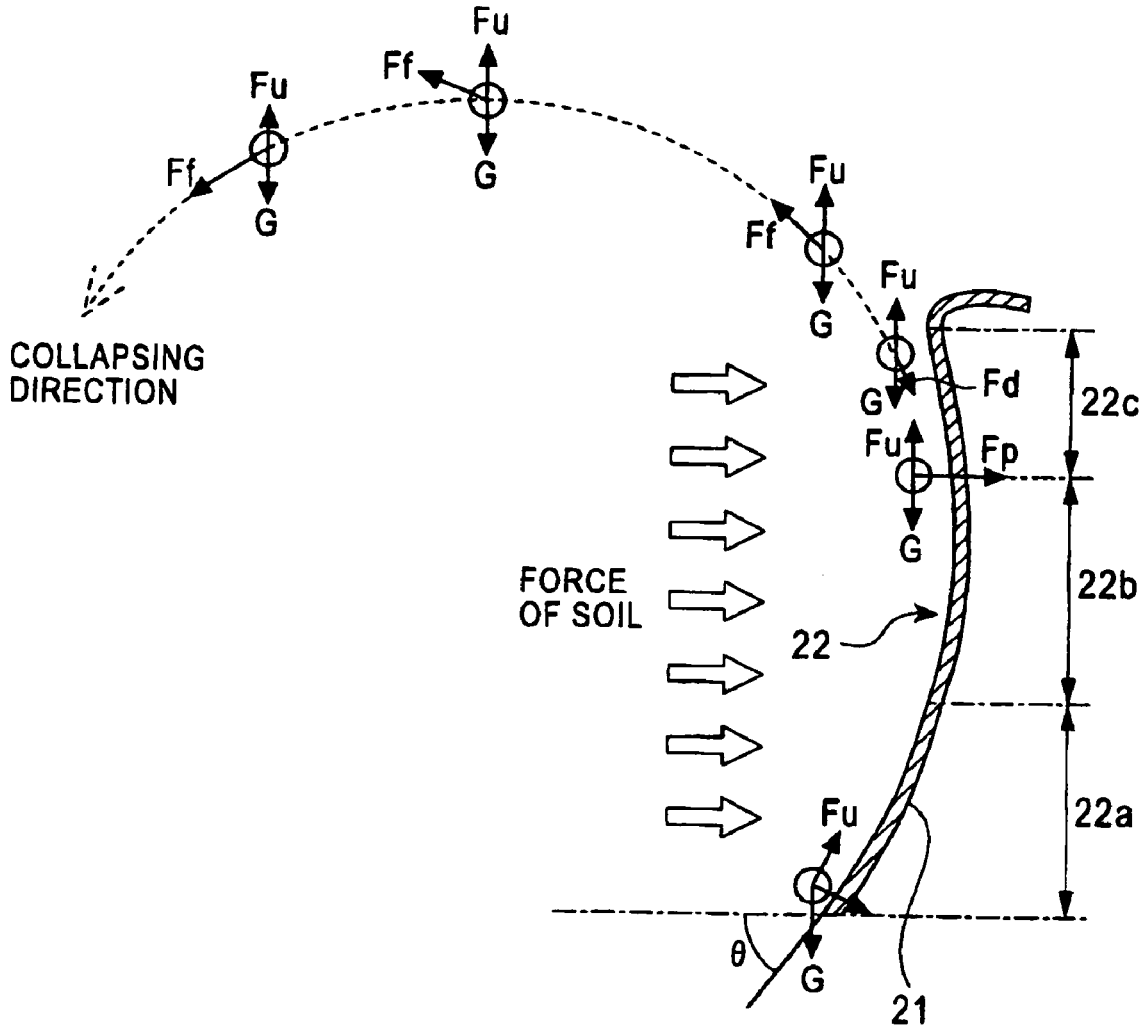
FIG. 1 is a cross-sectional view of a blade included in a dozer unit according to an embodiment of the present invention.
Figure 2:
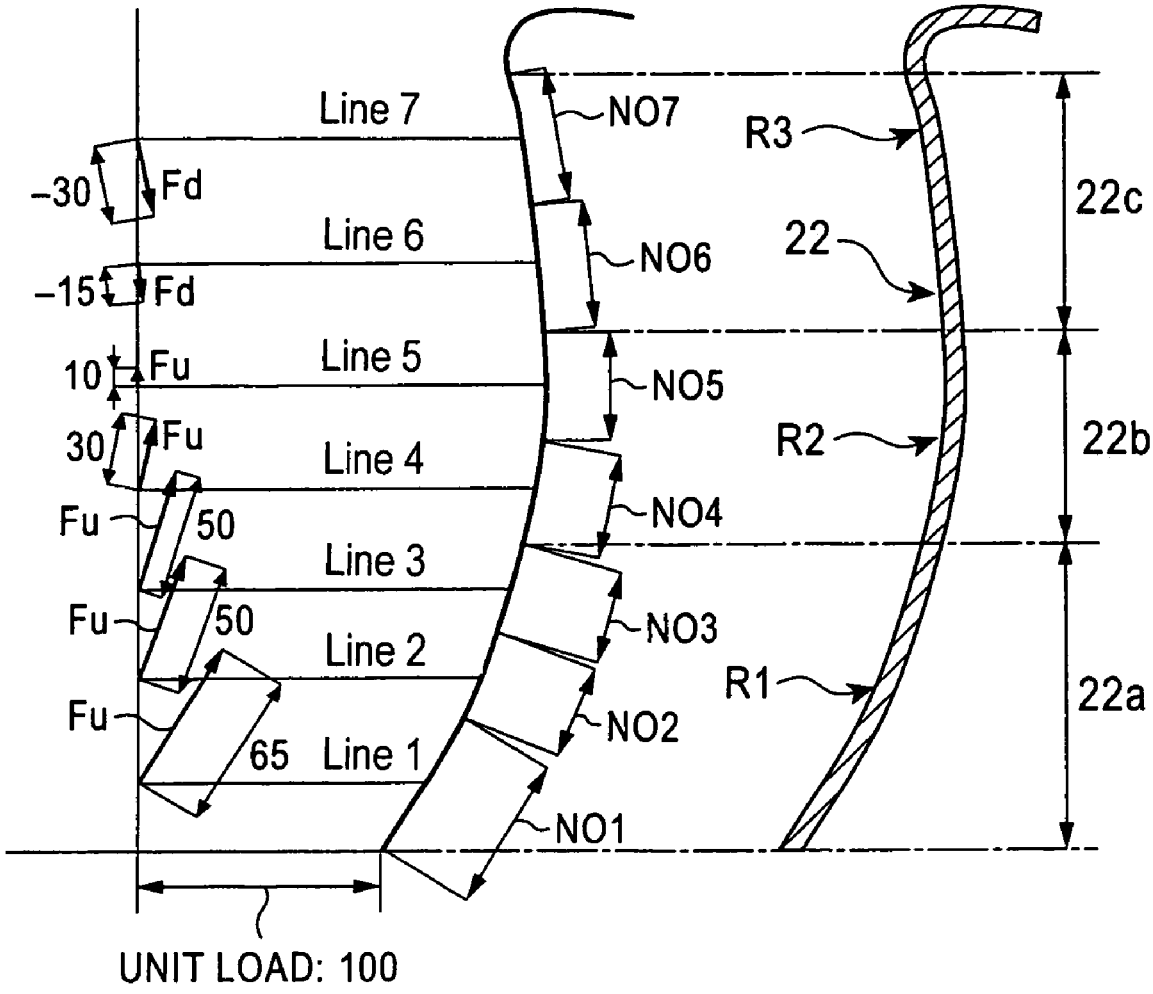
FIG. 2 is a schematic diagram illustrating a generation status of force components generated in sections of a blade surface of the blade with respect to a height direction of the blade.

FIGS. 1 and 2 illustrate a cross-sectional view of the blade 21 of the dozer unit 20 provided in the excavator according to the embodiment of the present invention.

The blade surface 22 defining the front surface of the blade 21 includes three curved surface portions having different curvature radii and extending continuously in the height direction of the blade surface 22.

Specifically, the blade surface 22 includes a lower surface portion 22*a* having the largest curvature radius R1 of the three surface portions, an intermediate surface portion 22*b* having the smallest curvature radius R2, and an upper surface portion 22*c* having an intermediate curvature radius R3.

In detail, the lower surface portion 22*a* is a curved surface portion that inclines backward in a state where the blade 21 is in contact with the ground so as to form the rake angle θ. On the other hand, the upper surface portion 22*c* is a curved surface portion that inclines forward such that the upper surface portion 22*c* is capable of rolling the dirt in the forward direction. Furthermore, the intermediate surface portion 22*b* is a curved surface portion that also inclines backward but has an angle of inclination that gradually becomes smaller, thus enabling the dirt to be transferred smoothly from the lower surface portion 22*a* to the upper surface portion 22*c*.

The shape of the blade surface 22 is determined in view of satisfying the following conditions:

1. Upward pushing force components Fu that push the dirt scraped with the lower end of the blade 21 upward along the blade surface 22 are generated.
2. A release force that moves the dirt forward is generated when the upper surface portion 22*c* of the blade 21 changes the direction of the upward pushing force components Fu to the forward direction.

3. A total downward pressing force ΣFd of downward pressing force components Fd, which are generated in response to the generation of the release force in the upper surface portion 22*c* (which may also be referred to as a release surface portion 22*c* hereinafter) of the blade 21, and a total upward pushing force ΣFu of the upward pushing force components Fu form the following relationship: ΣFu>ΣFd.
4. If each upward pushing force component Fu is indicated by a positive value and if each downward pressing force component Fd and a reduced amount of each upward pushing force component Fu caused when the dirt hits the release surface portion 22*c* are indicated by negative values, the value of force applied to the dirt at an endmost section of the release surface portion 22*c* is positive.

This will be described in further detail with reference to FIGS. 2 and 8 and Tables 1 to 3.

Figure 8:
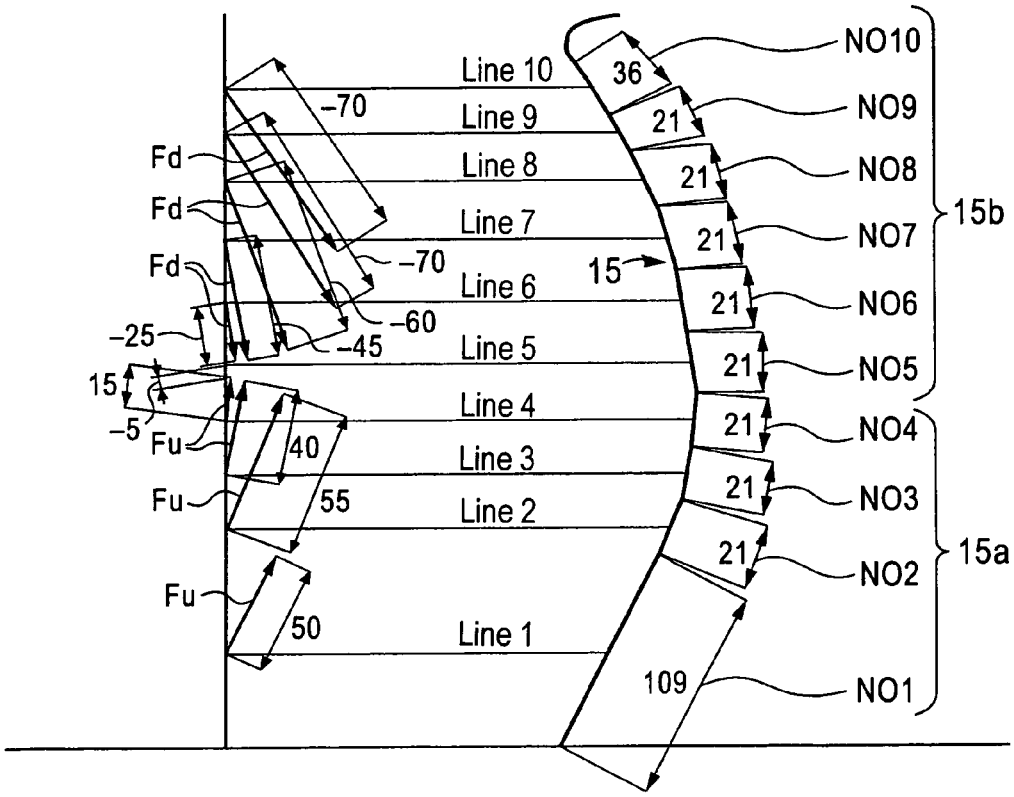
PRIOR ART FIG. 8
FIG. 8 is schematic diagram illustrating a generation status of force components generated in sections of a blade surface of a blade with respect to a height direction of the blade included in the dozer unit of the related art.

Similar to FIG. 8 illustrating the blade surface 15 of the related art, FIG. 2 illustrates the blade surface 22 which is divided into a plurality of sections (i.e. sections NO1 to NO7) in the height direction. Moreover, each section is given an approximate line, and the generation status of a force component generated in each section is determined by calculation.

Table 1 shows results obtained under the following conditions: a unit load of 100 is given to the lower end of the blade 21 so that a load is applied to the blade surface 22; and the approximate line in each section is permitted a dimensional error of 1 mm or less with respect to the curved blade surface 22.

TABLE 1

| LINE NO. | FORCE | AREA THAT RECEIVES FORCE | COLLECTIVE FORCE | TYPE OF FORCE | ACTUAL UPWARD PUSHING-FORCE |
|---|---|---|---|---|---|
| 1 | 65 | 65 | 4225 | Fu | +4225 |
| 2 | 50 | 35 | 1750 | Fu | +5975 |
| 3 | 50 | 35 | 1750 | Fu | +7725 |
| 4 | 30 | 45 | 1350 | Fu | +9075 |
| 5 | 10 | 45 | 450 | Fu | +9525 |
| 6 | −15 | 55 | −825 | Fd | +6986.18 |
| 7 | −30 | 55 | −1650 | Fd | +1159.429 |

*** "FORCE" × "AREA THAT RECEIVES FORCE" = "COLLECTIVE FORCE"

In the sections NO1 to NO3 defining the lower surface portion 22*a*, the upward pushing force components Fu are generated in the backward-upward direction and respectively have a magnitude of 65, 50, and 50.

In the sections NO4 and NO5 defining the intermediate surface portion 22*b*, the upward pushing force components Fu are also generated in the backward-upward direction and respectively have a magnitude of 30 and 10.

In the sections NO6 and NO7 defining the upper surface portion (i.e. release surface portion) 22*c*, the downward pressing force components Fd are generated in the backward-downward direction and respectively have a magnitude of 15 and 30. The downward pressing force components Fd in Table 1 are each given a negative sign (−) in order to make a distinction from the upward pushing force components Fu.

Accordingly, the shape of the blade surface 22 is determined such that the above force components are generated.

In contrast, according to the blade 12 of the dozer unit 10 of the related art, force components are generated as shown in FIG. 8 and Table 2 provided below. The blade 12 of the related art has substantially the same size as the blade 21 according to the embodiment of the present invention. However, in contrast to the blade 21, the blade 12 has a single curved surface having a uniform curvature radius R of, for example, 160 mm, and the surface is divided into ten sections NO1 to NO10. The generation status of a force component generated in each section is determined by calculation.

TABLE 2

| LINE NO. | FORCE | AREA THAT RECEIVES FORCE | COLLECTIVE FORCE | TYPE OF FORCE | ACTUAL UPWARD PUSHING FORCE |
|---|---|---|---|---|---|
| 1 | 50 | 110 | 5500 | Fu | +5500 |
| 2 | 55 | 21 | 1155 | Fu | +6655 |
| 3 | 40 | 21 | 840 | Fu | +7495 |
| 4 | 15 | 21 | 315 | Fu | +7810 |
| 5 | −5 | 21 | −105 | Fd | +7650.512 |
| 6 | −25 | 21 | −525 | Fd | +5496.482 |
| 7 | −45 | 21 | −945 | Fd | +2039.066 |
| 8 | −60 | 21 | −1260 | Fd | −510.278 |
| 9 | −70 | 21 | −1470 | Fd | −1591.88 |
| 10 | −70 | 35 | −2450 | Fd | −2788.34 |

*** "FORCE" × "AREA THAT RECEIVES FORCE" = "COLLECTIVE FORCE"

In the related art, the upward pushing force components Fu generated in the lower sections NO1 to NO4 respectively have a magnitude of 50, 55, 40, and 15 in that order from the section NO1. On the other hand, the upward pushing force components Fu generated in the remaining upper sections NO5 to NO10 respectively have a magnitude of −5, −25, −45, −60, −70, and −70 in that order from the section NO5.

Based on the above results, Table 3 below shows a comparison between the related art and the embodiment of the present invention. Specifically, the total upward pushing force ΣFu in the related art is 7810, whereas the total upward pushing force ΣFu according to the embodiment of the present invention is 9525. Moreover, the total downward pressing force ΣFd in the related art is −6755, whereas the total downward pressing force ΣFd according to the embodiment of the present invention is −2475.

TABLE 3

| | ΣFu | ΣFd | RATIO (ΣFu:ΣFd) |
|---|---|---|---|
| DOZER UNIT ACCORDING TO EMBODIMENT OF PRESENT INVENTION | 9525 | −2475 | 79%:21% |
| DOZER UNIT ACCORDING TO RELATED ART | 7810 | −6755 | 54%:46% |

In other words, in the related art, the ratio ΣFu:ΣFd is equal to 54%:46%, and therefore, the total upward pushing force ΣFu is about 1.2 times greater than the total downward pressing force ΣFd. Consequently, this means that the total upward pushing force ΣFu and the total downward pressing force ΣFd in the related art are substantially the same, i.e. ΣFu≈ΣFd. In contrast, in the embodiment of the present invention, the ratio ΣFu:ΣFd is equal to 79%:21%, and therefore, the total upward pushing force ΣFu is about 3.8 times greater than the total downward pressing force ΣFd.

Accordingly, ΣFu>ΣFd, which means that the total upward pushing force ΣFu is much greater than the total downward pressing force ΣFd.

Furthermore, according to an experiment performed by the inventors of the present invention, it has been found that an amount of energy loss caused when the dirt hits the release surface portion 22*c* (which will be referred to as release resistance hereinafter) actually leads to a reduction of the magnitude of the upward pushing force components Fu. For this reason, the actual upward pushing force remaining at the endmost section (section NO7) of the release surface portion 22*c* is lower than the value indicated above.

The values of the actual upward pushing force are indicated at the rightmost column in each of Tables 1 and 2. In the tables, a positive value corresponds to an upward pushing force, whereas a negative value corresponds to a downward pressing force and to a force that reduces an upward pushing force due to release resistance.

Referring to FIG. 8 and Table 2 of the related art, the release resistance is not generated in the sections NO1 to NO4 defining the lower surface portion 15*a* of the blade surface 15. For this reason, the total value of the upward pushing force components Fu is +7810.

On the other hand, the release resistance is generated in the sections NO5 to NO10 in addition to the generation of the downward pressing force components Fd. Thus, the actual upward pushing force is reduced by the amount of the release resistance and the downward pressing force components Fd. The actual upward pushing force calculated in view of this reduced amount is determined by first calculating the total value of a reduced amount caused by the release resistance in each section, then adding this value to the corresponding downward pressing force component Fd, and finally subtracting this determined value from the actual upward pushing force.

For example, with respect to the section NO5 under the following conditions: the actual upward pushing force at the section NO4 is 7810; force components generated due to release resistance at sections NO4 and NO5 are 29.99 and 30.00 (unit load of 30), respectively; the force-receiving area of the section NO5 is 21 (units); and the downward pressing force component Fd generated in the section NO5 has a magnitude of −105, a reduction rate of (29.99/30.00) acts upon each of 21 units within the section NO5 with respect to the upward pushing force component Fu. Consequently, a reduction rate of $(29.99/30.00)^{21}$ acts upon the section NO5, such that the following expression stands: $7810\times(29.99/30.00)^{21}-105$. Accordingly, the actual upward pushing force at the section NO5 is 7650.512.

Based on this value 7650.512 of the actual upward pushing force, the actual upward pushing force at the section NO6 can be determined. Similarly, the same calculation method may be applied up to the section NO10.

As a result, the actual upward pushing force at the section 10, i.e. the endmost section of the blade surface 15, is −2788.34. This means that the downward pressing force is greater than the upward pushing force. This is due to the fact that the absolute value of the total upward pushing force ΣFu is originally small (that is, the difference between the total upward pushing force ΣFu and the total downward pressing force ΣFd is small).

Figure 7:
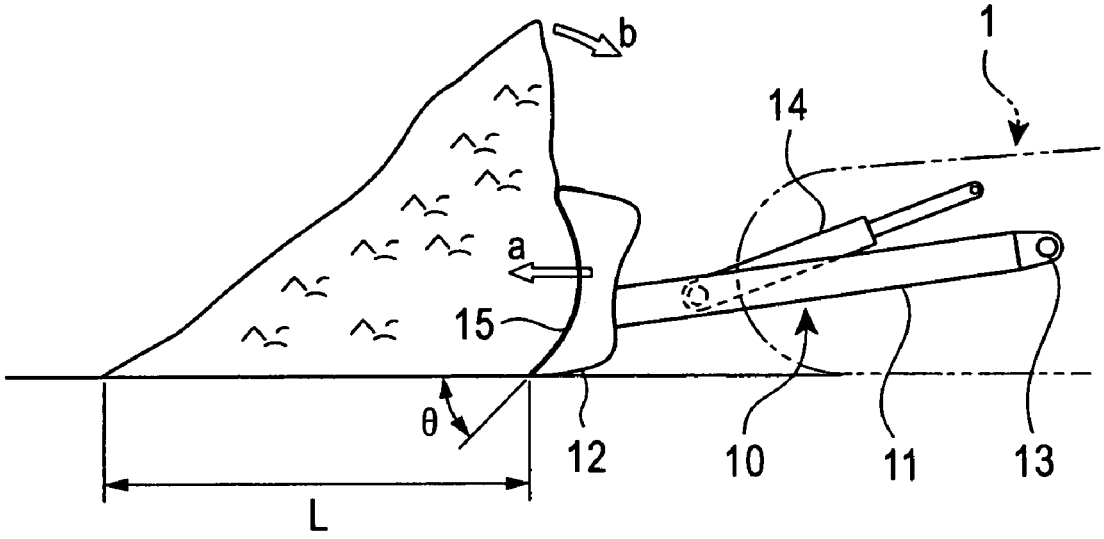
PRIOR ART FIG. 7
FIG. 7 is a side view of a dozer unit of related art.

Therefore, according to the related art, the upward pushing force is not effective at a region where the scraped dirt exceeds the height of the blade 12. This implies that a sufficient release force is not obtained. Accordingly, the dirt accumulates instead of rolling forward and thus forms a pile whose bottom portion L is long, as shown in FIG. 7. In response to an advancing force, the pile of dirt may easily collapse in the backward direction.

In contrast, according to the embodiment of the present invention referring to FIG. 2 and Table 1, as a result of determining the actual upward pushing force for each section using the same calculation method as above, the actual upward pushing force at the endmost section (i.e. the section NO7) of the release surface portion 22*c* is +1159.429 and is thus a sufficiently large positive value.

In other words, according to the embodiment of the present invention, the blade surface 22 has a shape such that in addition to the total upward pushing force ΣFu being greater than the total downward pressing force ΣFd, the value of force applied to the dirt at the endmost section (i.e. the section NO7 in Table 1) of the release surface portion 22*c* is a positive value.

Accordingly, referring to FIG. 1, even when the dirt is in a region exceeding the height of the blade 21, the total upward pushing force ΣFu is maintained to be greater than the total downward pressing force ΣFd. While receiving a sufficiently large release force Ff, the dirt is transferred in the forward direction like a tidal wave forming a parabolic arch due to its own weight G and its viscosity. The dirt then collapses at a position sufficiently distant from the blade 21.

Figure 3:
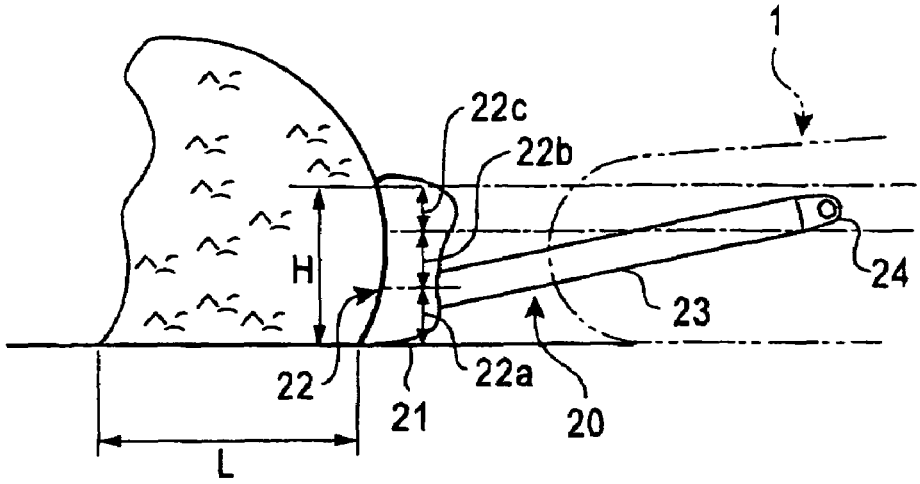
FIG. 3 is a side view of the dozer unit according to the embodiment of the present invention.

Accordingly, referring to FIG. 3, a pile of dirt having a short bottom portion L is formed and is quickly and smoothly pushed away towards the opposite lateral sides of the blade 21. This contributes to a higher efficiency of the earth removal operation.

In this case, since the ratio between the total upward pushing force ΣFu and the total downward pressing force ΣFd is set at 79:21 (approximately 8:2) as shown in Table 3, the total upward pushing force ΣFu is made sufficiently large, whereby the actual upward pushing force also becomes a sufficiently large positive value. As a result, a pile of dirt whose bottom portion L is short and whose bottom angle is close to 90° is formed. The ability to form such a pile of dirt is proven to show the most efficient results for performing an earth removal operation.

Specifically, by setting the ratio between the total upward pushing force ΣFu and the total downward pressing force ΣFd at approximately 8:2, the following conditions can be satisfied:

(i) the total upward pushing force ΣFu, which is a source of the release force Ff, is greater than the total downward pressing force ΣFd; and (ii) if each upward pushing force component Fu is indicated by a positive value and if each downward pressing force component Fd and a reduced amount of each upward pushing force component Fu caused when the dirt hits the release surface portion 22*c* are indicated by negative values, the value of force applied to the dirt at an endmost section of the release surface portion 22*c* is positive.

Accordingly, this allows for a formation of a pile of dirt whose bottom portion L is short and whose bottom angle is close to 90°, whereby an earth removal operation can be performed at the highest efficiency.

Such a preferable ratio may vary to a certain degree depending on the properties of the dirt, such as viscosity, and may alternatively include ratios that are within a close range of the ratio 8:2.

As described above, in the embodiment of the present invention, the blade surface 22 includes the plurality of continuously-extending curved surface portions having different radii, meaning that the blade surface 22 is entirely curved. In comparison with a case where a blade surface has a plurality of continuously-extending flat surface portions in which the dirt adheres to inflecting borders between the flat surface portions, the blade surface 22 is prevented from such a problem and allows the dirt to be transferred smoothly along the blade surface 22.

Figure 4:
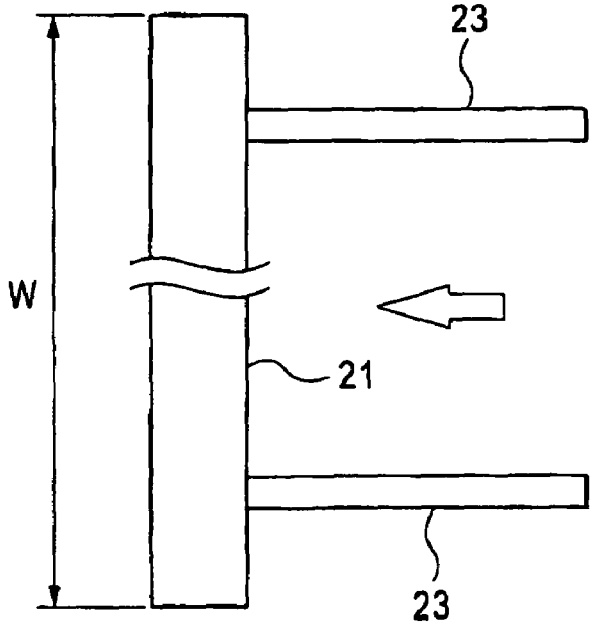
FIG. 4 is a schematic plan view of the dozer unit according to the embodiment of the present invention.

The blade 21 is attached in a manner such that the blade 21 is perpendicular to the traveling direction of the dozer unit 20 indicated by an arrow shown in FIG. 4. Thus, the blade 21 may be used as a support for lifting the excavator body when the underside of the excavator is to be, for example, inspected or cleaned. Moreover, the blade 21 may also be used with the excavating attachment unit 9 to hold an object therebetween. Accordingly, a unique function of the dozer unit 20 of the excavator can be achieved.

An upper limit value of the height of the blade 21 is determined such that the blade 21 does not interfere with the operation of the excavating attachment unit 9. In order to achieve an efficient earth removal function, a height H of the blade surface 22 (a dimension measured from the lower end of the lower surface portion 22*a* to the upper end of the release surface portion 22*c*) and a width W of the blade surface 22 (shown in FIG. 4) preferably have the following relationship: W=(4.4 to 5.7)×H. The dimension of the blade 21 determined using the above expression was discovered to be the most preferable by the inventors of the present invention.

If the width W of the blade surface 22 is smaller than a value determined using the above expression, the blade surface 22 is narrower in width than the lower traveling body 1. This is inefficient for performing an earth removal operation and is not practically appropriate. On the other hand, if the width W of the blade surface 22 is larger than a value determined using the above expression, the dirt cannot be efficiently pushed away towards the opposite lateral sides of the blade 21, meaning that the earth removal function of the blade surface 22 is practically not effective.

As an alternative to improving the efficiency of the earth removal operation, the entire blade 21 may be attached to the lower traveling body 1 at an angle in plan view with respect to the traveling direction of the lower traveling body 1, or may be inverted V-shaped in plan view. In these cases, however, the unique function of the dozer unit 20 of the excavator is not achieved due to the fact that the blade 21 cannot be used as a support for lifting the excavator body when the underside of the excavator is to be, for example inspected or cleaned, or that the blade 21 cannot be used with the excavating attachment unit 9 to hold an object therebetween.

In view of these circumstances, the blade 21 is most preferably attached perpendicular to the traveling direction in plan view. Even with this structure, a sufficiently efficient earth removal function can be achieved based only on the shape of the blade surface 22.

On the other hand, since an actual dozer operation is generally performed at a level higher than the ground level, it is highly important to take into account the workability in such conditions.

Accordingly, in order to achieve a highly-efficient earth removal operation at a level higher than the ground level, it is preferable that the angle of the upper surface portion (i.e. release surface portion) 22*c* of the blade surface 22 changes by a smallest possible degree between a state where the blade 21 is in contact with the ground and a state where the blade 21 is raised upward.

Figure 5A:
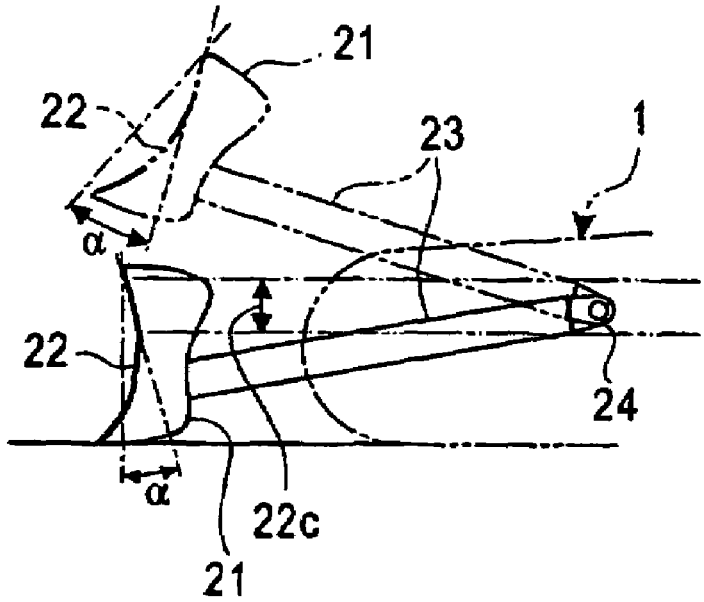
FIGS. 5A and 5B are schematic views of the dozer unit according to the embodiment of the present invention and a dozer unit of a comparative example, respectively, and each illustrate how the efficiency for performing an earth removal operation is affected by a change in an angle of a release surface portion of the corresponding dozer unit between a state where the blade is in contact with the ground and a state where the blade is raised.

According to the embodiment of the present invention, referring to FIGS. 3 and 5A, a height position where the dozer arm 23 is attached to the lower traveling body 1 via the arm shaft 24 is set within a height range defined by the upper surface portion (release surface portion) 22*c* of the blade surface 22 in a state where the blade 21 is in contact with the ground.

This allows for the angle of the release surface portion 22*c* to change only by a small degree when the blade 21 moves in the vertical direction. Consequently, a highly-efficient earth removal function can be achieved regardless of the vertical motion of the blade 21.

This will be described in detail while referring to a comparative example.

Figure 5B:
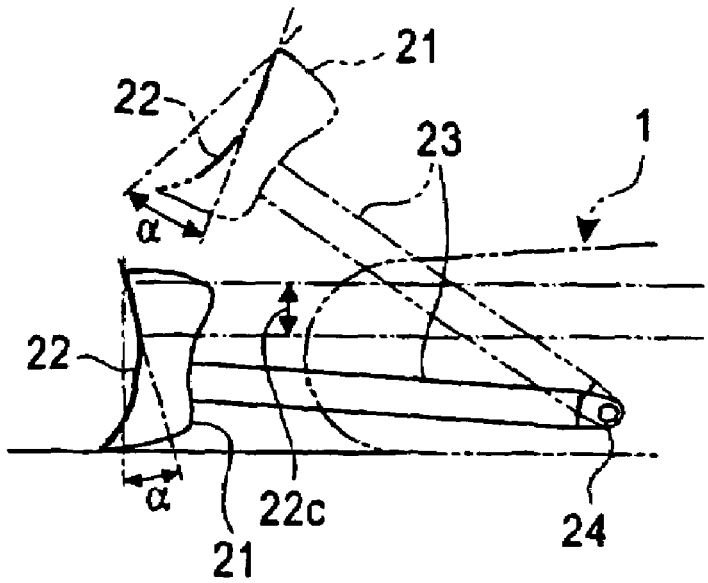

Specifically, FIGS. 3 and 5A illustrate the structure of the embodiment of the present invention in which the release surface portion 22*c* has an ideal angle α of 16° in a state where the blade 21 is in contact with the ground, and the attachment position of the dozer arm 23 is set at a height that is aligned with substantially the center of the height range defined by the release surface portion 22*c*. In contrast, FIG. 5B illustrates a comparative example in which the attachment position of the dozer arm 23 is set at a height that is lower than the release surface portion 22*c* and at substantially the lowest permissible position. The former and latter structures will now be compared. When the blade 21 is raised to a certain height in each of the former and latter structures, the angle α of the upper surface portion 22*c* in the former structure is 26°, whereas in the latter structure, the angle α is 29°. In other words, the change in the angle α of the release surface portion 22*c* according to the former structure is approximately 3° smaller than that according to the latter structure. Accordingly, as shown in FIGS. 3 and 5A, since the attachment position of the dozer arm 23 is set within the height range defined by the upper surface portion 22*c* of the blade surface 22 in a state where the blade 21 is in contact with the ground, a highly-efficient earth removal function can be achieved regardless of the vertical motion of the blade 21.

Here, the angle α of the release surface portion 22*c* is referred to as an angle formed between a tangent line with respect to the upper end of the release surface portion 22*c* of the blade surface 22 and a vertical line in a state where the blade 21 is in contact with the ground.

When mini-excavators are to be used to perform a dozer operation at a level lower than the ground level, such a level is limited to about several tens of millimeters since mini-excavators only have small driving power. For this reason, it is not significant in this case that the change in the angle of the upper surface portion 22*c* is small.

Although the present invention has been described with reference to the preferred embodiments in the attached figures, it is noted that equivalents may be employed and substitutions made herein without departing from the scope of the invention as recited in the claims.

What is claimed is:

1. An excavator comprising:

a lower traveling body; and a dozer unit attached to the lower traveling body, the dozer unit including a dozer arm and a blade attached to a front end of the dozer arm in a manner such that the blade is disposed at a predetermined rake angle with respect to the ground, wherein the blade has a blade surface used for performing an earth removal operation by moving the lower traveling body while the blade is set in contact with the ground, the blade surface satisfying the following conditions:

A) upward pushing force components Fu that push dirt upward along the blade surface are generated;

B) an upper part of the blade surface is provided with a release surface portion in which a forward-upward release force that rolls the dirt pushed upward by the upward pushing force components Fu towards the front of the blade is generated;

C) when downward pressing force components Fd are generated in response to the generation of the release force in the release surface portion, a total downward pressing force ΣFd and a total upward pushing force ΣFu form the relationship ΣFu>ΣFd; and D) if each upward pushing force component Fu is indicated by a positive value and if each downward pressing force component Fd and a reduced amount of each upward pushing force component Fu caused when the dirt hits the release surface portion are indicated by negative values, a value of force applied to the dirt at an endmost section of the release surface portion is positive.

2. The excavator according to claim 1, wherein a shape of the blade surface is set such that a ratio between the total upward pushing force ΣFu and the total downward pressing force ΣFd is substantially 8:2.

3. The excavator according to claim 1, wherein the blade surface includes a plurality of continuously-extending curved surface portions having different radii.

4. The excavator according to claim 1, wherein the blade is movable vertically about an attachment position where the dozer arm is attached to the lower traveling body, and wherein the attachment position of the dozer arm is set at a height that is within a height range defined by the release surface portion of the blade surface in a state where the blade is in contact with the ground.

5. The excavator according to claim 1, wherein the blade surface has a dimension such that a height H of the blade surface and a width W of the blade surface satisfy the following expression: W=(4.4 to 5.7)×H.

6. The excavator according to claim 1, wherein the blade is disposed perpendicular to a traveling direction of the lower traveling body in plan view.

* * * * *